United States Patent [19]

Meier et al.

[11] Patent Number: 5,004,047

[45] Date of Patent: Apr. 2, 1991

[54] HEADER FOR A TUBE-IN-TUBE HEAT EXCHANGER

[75] Inventors: Paul R. Meier, Tyler, Tex.; Brian D. Mueller, Syracuse, N.Y.

[73] Assignee: Carrier Corporation, Syracuse, N.Y.

[21] Appl. No.: 561,500

[22] Filed: Jul. 30, 1990

Related U.S. Application Data

[63] Continuation of Ser. No. 365,880, Jun. 14, 1989, abandoned.

[51] Int. Cl.[5] ..... F28F 9/18; F28D 7/14; F28D 7/02

[52] U.S. Cl. ..... 165/158; 165/163; 165/173; 165/178; 62/238.6; 62/238.7; 29/890.043; 29/890.052

[58] Field of Search ..... 165/163, 158, 154, 179, 165/177, 173, 178; 285/137.1; 62/238.6, 238.7; 29/890.043, 890.052

[56] References Cited

U.S. PATENT DOCUMENTS

| | | | |
|---|---|---|---|
| 2,368,391 | 1/1945 | Young | 165/178 |
| 2,844,360 | 7/1958 | Buri | 165/158 |
| 3,163,210 | 12/1964 | Horrocks | 165/163 |
| 3,310,103 | 10/1964 | Osborne . | |
| 3,473,348 | 10/1969 | Bottum | 165/154 |
| 4,254,826 | 3/1981 | Adams | 165/158 |
| 4,305,460 | 12/1981 | Yampolsky | 165/179 |
| 4,402,359 | 9/1983 | Carnavos et al. | 165/179 |
| 4,585,058 | 4/1986 | Pierrey . | |
| 4,588,026 | 5/1986 | Hapgood . | |
| 4,590,990 | 5/1986 | George . | |
| 4,611,655 | 9/1986 | Molignoni . | |
| 4,646,819 | 3/1987 | Pridham . | |
| 4,739,634 | 4/1983 | Watanabe . | |
| 4,781,246 | 11/1988 | Golben . | |

FOREIGN PATENT DOCUMENTS

| | | | |
|---|---|---|---|
| 535471 | 8/1955 | Belgium | 285/137.1 |
| 1148932 | 6/1983 | Canada | 165/163 |
| 2351529 | 4/1975 | Fed. Rep. of Germany | 165/163 |
| 2815885 | 10/1979 | Fed. Rep. of Germany | 165/163 |
| 3021028 | 12/1981 | Fed. Rep. of Germany | 165/163 |
| 2155770 | 4/1973 | France | 165/163 |
| 2494829 | 5/1982 | France | 165/179 |
| 402910 | 5/1966 | Netherlands | 165/158 |
| 513511 | 10/1939 | United Kingdom | 165/177 |

*Primary Examiner*—John Ford
*Attorney, Agent, or Firm*—Dana F. Bigelow

[57] ABSTRACT

A header for a tube-in-tube heat exchanger is formed in a single piece such that the manifold plate in one end thereof is integrally formed with the header body. Such a design eliminates the process of brazing the manifold plate into the header body, thus substantially simplifying the assembly process. In order to accommodate thinner walled tubes and a thinner manifold plate, reinforcing sleeves are placed around the inner tubes ends and are brazed in place in the manifold plate openings.

11 Claims, 3 Drawing Sheets

HEADER FOR A TUBE-IN-TUBE HEAT EXCHANGER

This application is a continuation of application Ser. No. 365,880 filed June 14, 1989, now abandoned.

BACKGROUND OF THE INVENTION

This invention relates generally to heat exchangers and, more specifically, to a header apparatus for a tube-in-tube heat exchanger.

The most common type of heat pump is one wherein heat is either transferred to or from a refrigerant by way of a heat exchanger which has ambient air flowing thereover. Such a system is sometimes referred as an air source heat pump since it is the condition of the ambient air which is applied to change the temperature of the refrigerant. In a similar manner, where there is a source of water, such as a pond or the like, which can be used to temper the condition of a refrigerant, a so called water source heat pump is used to cool or heat the refrigerant by way of a heat exchanger having water flowing therethrough.

Typically, such a water-to-refrigerant heat exchanger is in the form of a so called tube-in-tube heat exchanger wherein a single or a plurality of inner tubes are disposed in an outer tube, and the liquid and the refrigerant are made to flow through the respective outer and inner tubes, or vise versa, such that heat transfer is effected across the radial dimensions of the inner tube(s). In order to maintain a separation between the liquid and the refrigerant in such a system, it is common to provide a header for the purpose of defining a common boundary between the liquid and the refrigerant flow circuits and for holding the ends of the inner tubes. Heretofore, this has been accomplished by the use of a intermediate plate, separate from the header body, to function as the separator/manifold between the water and the refrigerant. In order to secure this intermediate plate within the header body, it was first necessary, with some difficulty, to install it into the desired position, and then to secure it in that position. Gas welding or flame brazing was typically used to braze the plate in place. Either of these approaches tends to heat a large amount of material, thus requiring more brazing alloy and larger headers to prevent alloy reflow. That is, where two distinct brazed joints are located in close physical proximity, unless they can be brazed simultaneously, the brazing of the second joint will tend to cause a melting of the braze of the first joint. And even when they can be brazed simultaneously, if thin wall tubing is being used, one must avoid the prolonged holding of the metal at the brazing temperature since it can compromise the strength of the metal. Since flame brazing requires longer times at the brazing temperature, the inner tubing is generally required to have relatively thick walls so as to consistently obtain highly reliable joints. While there is thus a need for relatively thick walled tubing, it is recognized that thin walled inner tubing is desirable because it offers improvements in heat transfer characteristics, cost and weight.

In addition to the difficulty in brazing thin walled tubes as discussed hereinabove, it is also recognized that the relative thicknesses of the elements being brazed (i.e. the thickness of the tubes and the thickness of the plate) should be comparable. That is, if the plate is thick and the tubes are thin, it is very difficult to get consistent and strong brazed joints throughout. Further, if the thickness of the plate is reduced so as to accommodate the thin walled tubing, then the strength of the thin walled plate under high pressures may not be sufficient to prevent deformation of the plate, which in turn may cause failure of the tubes.

It is, therefore, an object of the present invention to provide an improved header structure for a tube-in-tube heat exchanger.

Another object of the present invention is the provision for reducing the difficulty of installing the separator/manifold member in a tube-in-tube heat exchanger header.

Yet another object of the present invention is the provision for a tube-in-tube heat exchanger which can accommodate the use of relatively thin walled inner tubes.

Still another object of the present invention is the provision for a tube-in-tube heat exchanger which allows the use of both thin walled tubes and a relatively thin separator/manifold member without causing tube failure under higher pressure operation.

Yet another object of the present invention is the provision in a tube-in-tube heat exchanger for preventing tube failure when the separator/manifold member flexes under higher pressures.

Still another object of the present invention is the provision for a tube-in-tube heat exchanger header which is economical to manufacture and practical and effective in use.

These objects and other features and advantages become more readily apparent upon reference to the following description when taken in conjunction with the appended drawings.

SUMMARY OF THE INVENTION

Briefly, in accordance with one aspect of the invention, the header member of a tube-in-tube heat exchanger is formed of a single piece which includes, at one end thereof, a separator/manifold wall which forms the boundary between the water and the refrigerant. Since the requirement for brazing the separator/manifold wall into the header is eliminated, it is possible to use relatively thin walled inner tubes which can easily be brazed into their manifold openings by way of an induction brazing process. A cap is then placed over the end of the header, in surrounding relationship with the manifold wall, to thereby complete the internal flow circuit.

By yet another aspect of the invention, in order to prevent failure of thin walled tubes when a relatively thin walled separator/manifold member is caused to deform due to high pressures being exerted thereon, a reinforcing sleeve is placed around each of the tubes to prevent them from bending at locations near their ends. The sleeves are brazed on their outside to the plate and on their inside to the tubes so as to prevent leakage and to strengthen its reinforcing characteristics.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
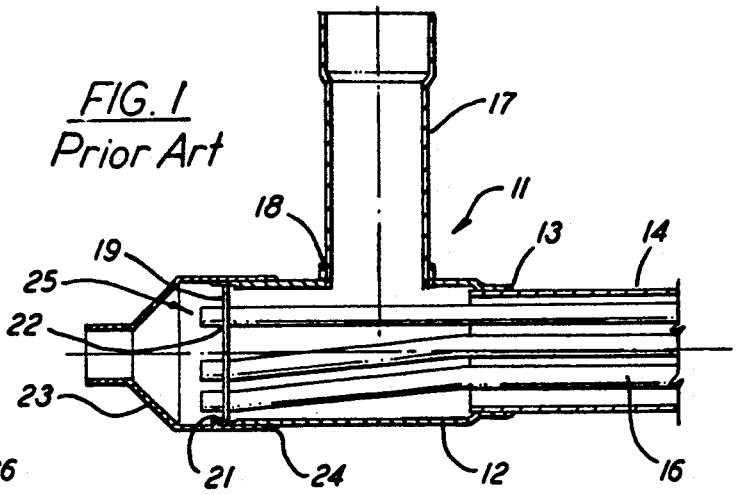
FIG. 1 Prior Art
FIG. 1 is a tube-in-tube heat exchanger header in accordance with the prior art.

Referring now to FIG. 1, there is shown a header member 11 for use with a tube-in-tube heat exchanger in accordance with the prior art. A cylindrical header body 12 is brazed at joint 13 to a jacket 14 for containing the outer fluid flow. A plurality of relatively thick walled (i.e. greater than 0.016 inches) inner tubes 16 are disposed in both the jacket 14 and the header body 12. A stub tube 17 is brazed in the side opening of the body 12 by a joint 18 so as to further define the flow path of the outer fluid.

The boundary between the outer and inner fluid comprises a separator/manifold plate 19 which is brazed in place near the end of the header body 12. The plate 19, which is relatively thick so as to withstand the high pressures which may be exerted thereon, is brazed by a joint 21 which extends around the entire periphery of the plate so as to securely attach it to the internal surface of the header body 12.

Formed in the plate 19 are a plurality of openings 25 for receiving the ends of the individual inner tubes 16 therein. The tubes 16 are then brazed into those openings 25, with the brazed joints 22 extending around the entire periphery of the tubes so as to securely seal them in the openings and complete the fluid tight boundary between the outer and inner fluid compartments. The inner fluid compartment is completed by way of a cap 23 which fits securely over the one end of the header body 12 and is brazed in placed by joint 24.

It is recognized that such a prior art header device is difficult to manufacture and exhibits certain performance deficiencies. In the assembly of the various components, brazing is the usual process for securing them in place. In the assembly of the plate 19 it is first necessary to place the plate in its desired position and then to hold it in that position while brazing around its entire circumference. It is preferred, but difficult, to simultaneously braze the individual tubes 16 into the plate openings 25. As an alternative, the tubes can be brazed in separately, with care being taken that the earlier brazed joint around the periphery of the plate 19 is not unbrazed in the process. Finally, when the cap 23 is placed in position and brazed at the joint 24, care must be taken that the joint 24 is separated from the joint 21 by a sufficient distance such that the brazing of the joint 24 does not cause an unbrazing of the joint 21. For this reason, it has been necessary to have considerable overlap between the cap 23 and the end of the header body 12 as shown.

Figure 2:
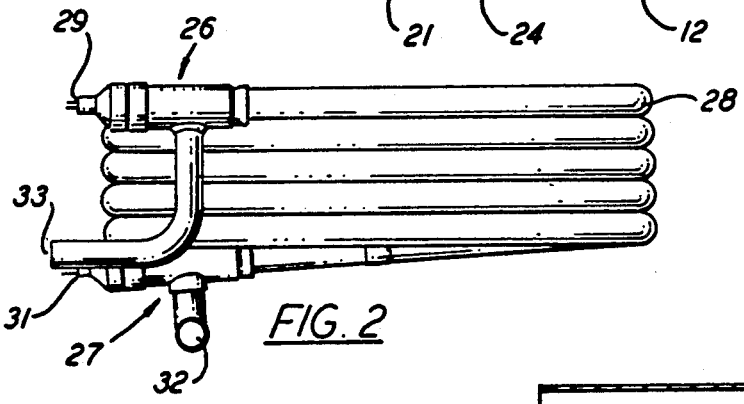
FIG. 2 is a front elevational view of a tube-in-tube heat exchanger in accordance with the present invention.

Referring now to FIG. 2, there is shown a pair of headers 26 and 27 in accordance with the present invention. The headers 26 and 27 are attached to opposite ends of a typical tube-in-tube heat exchanger coil 28 which is formed in a helical pattern as shown. It will, of course, be understood that the header structure of the present invention can be applied to any other form of tube-in-tube heat exchanger as well.

In operation, refrigerant flow (inner fluid) enters the inlet 29 and passes through the entire length of the inner tubes 16 and is discharged from the discharge opening 31. The outer flow is preferably in a counterflow direction such that the water enters the stub tube opening 32, pass through the entire jacket of the coil 28 and exits from the stub tube discharge opening 33. Again, it will be understood that various other embodiments may be employed while using the header of the present invention. For example, in a heat pump, it may be more convenient to have parallel flow rather than counterflow in one of the modes such as the heating mode. Also, where a single inner tube is employed, it may be desirable to route the water through the inner tube and the refrigerant through the outer tube.

Figure 4:
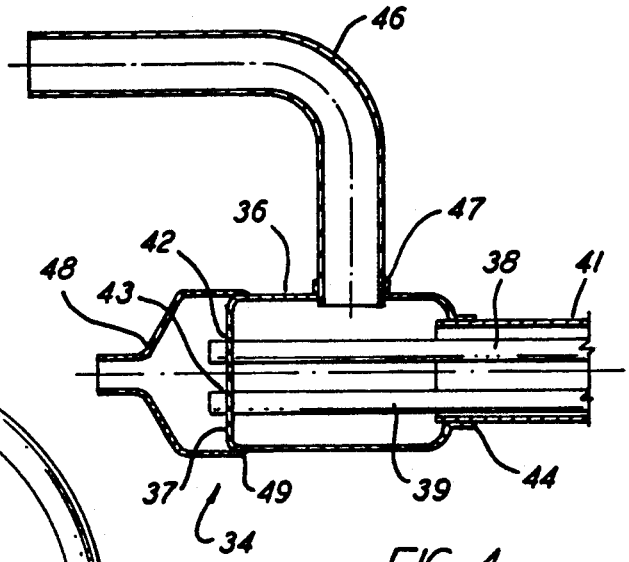
FIG. 4 is an end portion thereof showing the header member.
Figure 3:
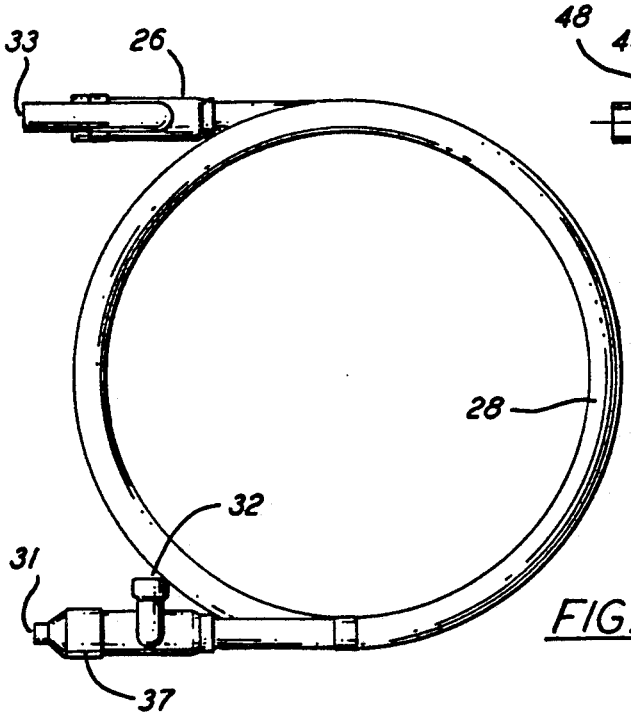
FIG. 3 is a top view thereof.

Referring now to FIG. 4, the present invention is shown generally at 34 as comprising a single piece header body 36 having a manifold plate 37 which is integrally formed with a cylindrical portion of the header body 36 as shown. A pair of preferably relatively thin walled (i.e. less than 0.016 inches) inner tubes 38 and 39 are disposed in the jacket 41 and the header body 36 as shown with their ends projecting through respective openings 42 and 43 in the manifold plate 37. The tubes 38 and 39 are brazed in the openings 42 and 43 in a manner to be described hereinafter.

The jacket 41 is brazed into the header body 36 at a joint 44, and the stub tube 46 is brazed in a side opening of the header body 36 at a joint 47. The cap 48 is brazed to the header body 36 at a joint 49. Here it will be seen that, since there is no joint at the interface of the manifold plate 37 and the header body 36, the overlap between the cap 48 and header body 36 can be minimized such that the joint 49 is relatively close to the periphery of the manifold plate 37 as shown. In this way, a substantial savings of material is obtained.

The inner tubes 38 and 39 are preferably of the enhanced type wherein spiral grooves are formed on the inner side of the tubes to enhance the heat transfer performance characteristics thereof. For example, such an enhanced tube may have a nominal thickness of 0.016 inches, but the thickness at the grooves (i.e. minimum thickness) might be 0.012 inches (i.e. a so-called "12 wall tube").

Figure 5:
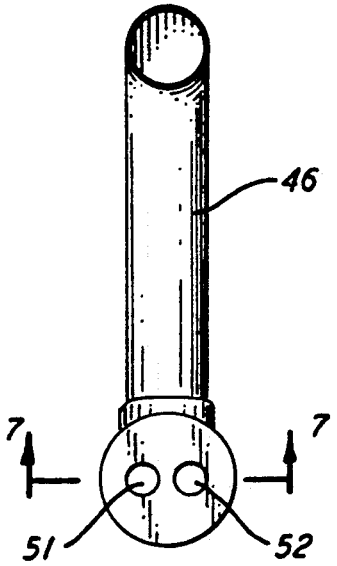
FIG. 5 is an end view of a header member.
Figure 6:
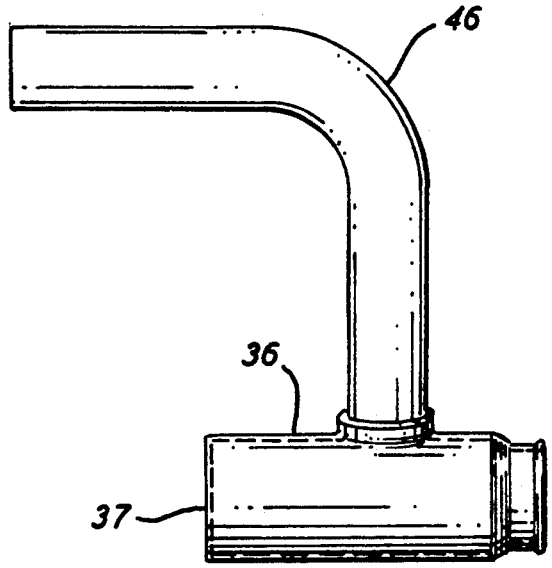
FIG. 6 is a elevational view thereof.
Figure 7:
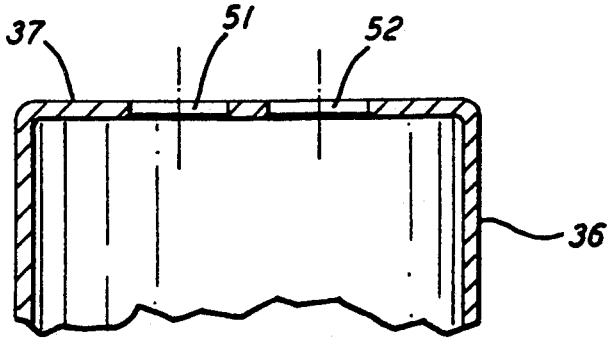
FIG. 7 is a sectional view thereof as seen along lines 7—7 in FIG. 5.

Referring now to FIGS. 5-7, a slightly modified version of the header body 36 is shown wherein the openings 51 and 52 are disposed in a side by side relationship rather than one over the other as shown in FIG. 4. In either case, the openings 51 and 52 are formed in the same manner by drilling or punching out the openings from the manifold plate 37. It will be seen that a slight chamfer is preferably formed on the inner end of the openings so as to facilitate the easy installation of the inner tubes into the openings prior to their being brazed into their secured positions.

The forming of the manifold plate 37 as an integral part of the header body 36 is accomplished by a known process of "spinning." The process involves the spinning on its axis of an open cylinder and the gradual folding over of its end, in successive stages, by the use of a spinning mallet which is applied to its end. The end of the folded over portion eventually closes at a central point such that the resulting manifold plate 37 is continuous from one side to the other (with the possible exception of a very small hole in the middle which can be closed by a flow of brazing material thereover) and has a thickness which is substantially the same as the thickness of the header body 36.

Since the thickness of the header body 36 is relatively thin as compared with a manifold plate of the prior art, the thickness of the manifold plate 37 formed integrally therewith is relatively thin (i.e. they are of substantially the same thickness). Where the manifold body 36 is relatively small, such as where only two inner tubes are used as shown in FIGS. 5–7, the strength of the manifold plate 37 should be sufficient to withstand high pressures even though it is relatively thin. However, where a larger number of tubes are utilized and the diameter of the manifold plate 37 must therefore be increased, the relatively thin wall of the manifold plate 37 can be cause for problems.

Figure 8:
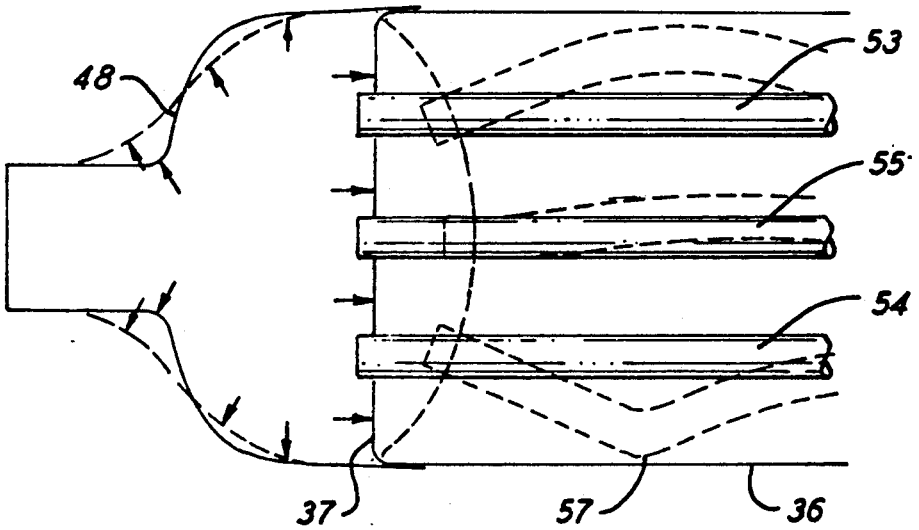
FIG. 8 is a schematic illustration of the header member as shown with dynamic forces acting thereon.

In this regard, there is shown in FIG. 8 a larger diameter header 36 wherein there are a plurality of circumferentially spaced tubes (e.g. nine), a portion of which are indicated at 53 and 54, and a centrally disposed tube indicated at 55. The thin walled tubes are brazed into openings in the manifold plate 37 in manner described hereinabove. When the inner flow circuit is subjected to high pressures, then both the cap 48 and the manifold plate 37 tend to be deformed toward a generally spherical configuration as indicated by the dotted lines. When this occurs, the inner tubes 53 et al. tend to bow outwardly as indicated.

Related to this phenomena, it should also be recognized that in the process of brazing the inner tubes into the openings of the manifold plate 37, the tubes are heated near their ends, and the heat is conducted longitudinally along the tubes for a distance known as the "heat affected zone." The copper in the "heat affected zone" is annealed in the process and therefore weakened. When the extent of bowing out as described hereinabove reaches a point where the weakened tube can no longer support the stress, the tube will bend and fail as shown at point 57 in FIG. 8. Such a failure will, of course, cause a breakdown in the system since the integrity between the separated inner and outer flow circuits will be lost.

Figure 9:
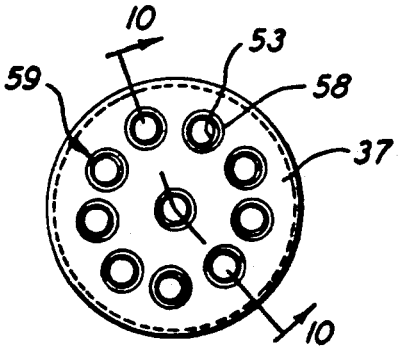
FIG. 9 is an end view of a modified embodiment of the present invention.
Figure 10:
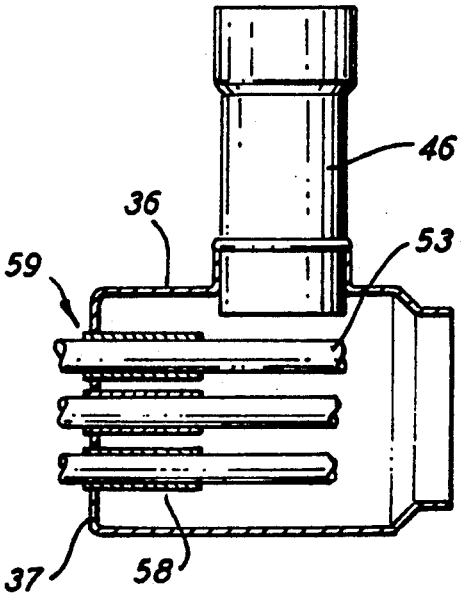
FIG. 10 is a side elevational view thereof.
Figure 11:
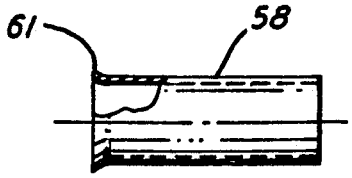
FIG. 11 is a longitudinal view of a sleeve portion of the present invention.

To address this problem, a modified version of the present invention is shown in FIGS. 9–11 wherein a plurality of reinforcing sleeves 58 are inserted into the openings 59 of the manifold plate 37. The tubes, 53 et al., are then inserted into the reinforcing sleeves 58 and brazed into place. The reinforcing sleeves are sized in such a way that their outer dimensions provide a relatively close fit in the manifold plate openings 59, and their inner diameter is such that the tubes 53 et al. fit loosely, but relatively well centered therein. As will be seen in FIG. 11, the one end of the reinforcing sleeve 58 which fits into the opening 59 is preferably chamfered at 61 for facilitating the assembly process. The length of the sleeves is selected such that reinforcement of the inner tubes is provided to the longitudinal point beyond the weakest point of the heat affected area.

Assembly is preferably accomplished in the following manner. The plurality of inner tubes, 53 et al., projecting from the jacket are squeezed together and the header body 36 is placed thereover such that the ends of the tubes project through the openings 59 of the manifold plate 37. The reinforcing sleeves 58 are then inserted into the openings 59, in overlapping relationship with the inner tubes, 53 et al., until the chamfer 61 comes to rest against the outer surface of manifold plate 37. The reinforcing sleeves 58 are then brazed into the openings 59, and the inner tubes, 53 et al., are brazed into the reinforcing sleeves 58. This is all accomplished on the outer side of the manifold plate 37 where all the members are easily accessible. All of the brazed joints at the manifold plate 37 are accomplished substantially at the same time by an induction brazing process. A cap 48 is then installed and brazed to the header body 36 as shown in FIG. 4. The header body 36 is also brazed, at its other end, to the jacket as shown in FIG. 4. The stub tube 46 may be brazed into the side opening of the header body 36 either before or after the process described hereinabove.

While the present invention has been disclosed with particular reference to a preferred embodiment, the concepts of this invention are readily adaptable to other embodiments, and those skilled in the art may vary the structure thereof without departing from the essential spirit of the invention.

What is claimed is:

1. An improved header apparatus of the type which interconnects an external flow circuit and an internal flow circuit in a tube-in-tube heat exchanger comprising:

a header body being tubular in form and having an open end for fluid connection to a jacket, said jacket and said header body defining the outer boundary of the external flow circuit and containing at least one inner tube which has a nominal thickness of less than 0.016 inches and which defines the outer boundary of the internal flow circuit;

said header body having an opening in one side thereof for connection to a first conduit for fluid communication with said jacket by way of said header body;

said header body further having an integrally connected closed end for defining a mutual boundary between the external and internal flow circuits, said closed end being relatively thin so as to be susceptible to deformation and having at least one opening formed therein for receiving said at least one inner tube therein such that an open end of said at least one inner tube is fluidly connected to a portion of said internal flow circuit on one side of said closed end;

a cap interconnected to said header body at said closed end for further defining said internal flow circuit and having an opening for fluid communication with a second conduit; and a reinforcing sleeve disposed around said at least one inner tube near said at least one opening to restrict said tube from lateral deformation when said closed end is caused to deform.

2. An improved header apparatus as set forth in claim 1 wherein said closed end is disposed substantially opposite said open end of said header body.

3. An improved header apparatus as set forth in claim 1 wherein said closed end is substantially planar in form.

4. An improved header apparatus as set forth in claim 1 and including means for fluidly sealing said at least one opening between the outer periphery of said at least one inner tube and the surrounding structure of said closed end.

5. An improved header apparatus as set forth in claim 4 wherein said sealing means includes a brazing material.

6. An improved header apparatus as set forth in claim 5 wherein said brazing material is applied by way of an induction brazing process.

7. An improved header apparatus as set forth in claim 1 wherein said reinforcing sleeve extends into said at least one opening.

8. An improved header structure for a tube-in-tube heat exchanger of the type having an outer jacket for containing an outer fluid flow and for containing at least one inner tube adapted to conduct an inner fluid flow, a header providing outer fluid flow communication into the jacket and to the outer surface of said at least one inner tube, and a manifold plate disposed in the header for separating the outer and inner fluid flows, comprising:

a single piece header and manifold plate combination wherein the manifold plate is integrally formed as one end of said header and has at least one opening formed therein for receiving said at least one inner tube to be secured therein wherein said at least one inner tube has a nominal thickness which is less than 0.016 inches and wherein said manifold plate is relatively thin so as to be susceptible to deformation;

a cap which is secured to said header one end to form a manifold for containing the inner fluid flow and for providing fluid communication with a conduit to be connected thereto; and a reinforcing sleeve disposed around said at least one inner tube near said at least one opening to restrict said tube from internal deformation when said manifold plate is caused to deform.

9. An improved header structure as set forth in claim 8 wherein said jacket is formed in a helical pattern.

10. An improved header structure as set forth in claim 8 wherein said at least one inner tube a reinforcing sleeve combination is secured in said at least one opening by way of an induction brazing process.

11. An improved header structure as set forth in claim 8 wherein said reinforcing sleeve extends into said at least one opening.

* * * * *